US008269550B2

(12) United States Patent
Jurasek et al.

(10) Patent No.: US 8,269,550 B2
(45) Date of Patent: Sep. 18, 2012

(54) TEMPERATURE AND PROCESS DRIVEN REFERENCE

(75) Inventors: Ryan Andrew Jurasek, S. Burlington, VT (US); Richard Michael Parent, Shelburne, VT (US)

(73) Assignee: Nanya Technology Corp., Kueishan, Tao-Yuan Hsien (TW)

( * ) Notice: Subject to any disclaimer, the term of this patent is extended or adjusted under 35 U.S.C. 154(b) by 96 days.

(21) Appl. No.: 12/610,369

(22) Filed: Nov. 2, 2009

(65) Prior Publication Data

US 2011/0102057 A1 May 5, 2011

(51) Int. Cl.
*G05F 3/02* (2006.01)
*G05F 1/10* (2006.01)

(52) U.S. Cl. ..... 327/540; 327/512

(58) Field of Classification Search ..... 327/512–513, 327/538–543

See application file for complete search history.

(56) References Cited

U.S. PATENT DOCUMENTS

| | | | | |
|---|---|---|---|---|
| 7,075,813 | B2 * | 7/2006 | Moriyama et al. | 365/148 |
| 7,504,878 | B2 * | 3/2009 | Lin | 327/540 |
| 7,750,716 | B2 * | 7/2010 | Hosoya | 327/308 |
| 2009/0080267 | A1 * | 3/2009 | Bedeschi et al. | 365/189.09 |

* cited by examiner

*Primary Examiner* — Quan Tra
(74) *Attorney, Agent, or Firm* — Winston Hsu; Scott Margo

(57) ABSTRACT

A reference voltage generation circuit for generating a reference voltage that can adaptively depend on temperature and process includes: a comparator, having a process, temperature and voltage (PVT) insensitive reference as a first input, and a feedback of the output as a second input, for generating a voltage reference output; a first resistor, coupled to the output of the operational amplifier; a second and a third variable resistor coupled in parallel, and coupled between the first resistor and ground; and a transistor, coupled between the third variable resistor and ground.

3 Claims, 3 Drawing Sheets

TEMPERATURE AND PROCESS DRIVEN REFERENCE

BACKGROUND OF THE INVENTION

1. Field of the Invention

The present invention relates to a generated voltage reference that can selectively track with variations in temperature or be process, voltage and temperature (PVT) independent.

2. Description of the Prior Art

Many circuits use voltage references to generate outputs that are a fraction of the input but follow the input's characteristics. These generated references can then be input to another system.

A typical circuit for generating a reference voltage takes a PVT independent reference, and generates a PVT independent output. Please refer to FIG. 1. FIG. 1 is a diagram of a reference voltage generation circuit 100 according to the prior art. The circuit comprises a comparator 150, having a PVT independent reference as a first input, and feedback from the output as the second input. The output is further coupled to a first resistor R1 and a second resistor R2 which are coupled in series, the second resistor R2 being coupled to ground. The second resistor R2 is a variable resistor, for varying the point at which the output is generated. This output will also be PVT independent. Once the resistance of the second resistor R2 is set, the generated output voltage will remain constant.

For some circuits, however, it is impractical to operate over all temperature conditions. For example, at low temperatures, circuit components will have a performance problem. At high temperatures, the problem of leakage current occurs. It is therefore advantageous to provide a reference voltage generation circuit that can provide an output that has some dependency on temperature variations.

SUMMARY OF THE INVENTION

A reference voltage generation circuit for generating a reference voltage that can adaptively depend on temperature and process according to an exemplary embodiment of the present invention comprises: a comparator, having a process, temperature and voltage (PVT) insensitive reference as a first input, and a feedback of the output as a second input, for generating a voltage reference output; a first resistor, coupled to the output of the operational amplifier; a second and a third variable resistor coupled in parallel, and coupled between the first resistor and ground; and a transistor, coupled between the third variable resistor and ground.

These and other objectives of the present invention will no doubt become obvious to those of ordinary skill in the art after reading the following detailed description of the preferred embodiment that is illustrated in the various figures and drawings.

DETAILED DESCRIPTION

The present invention provides a circuit that can generate an output according to a PVT independent reference, where the output can be temperature independent, temperature dependent, or highly temperature dependent. This allows for greater flexibility in the reference generation circuit's applications, ensuring the circuit can be used in a wide variety of operating environments.

Figure 1:
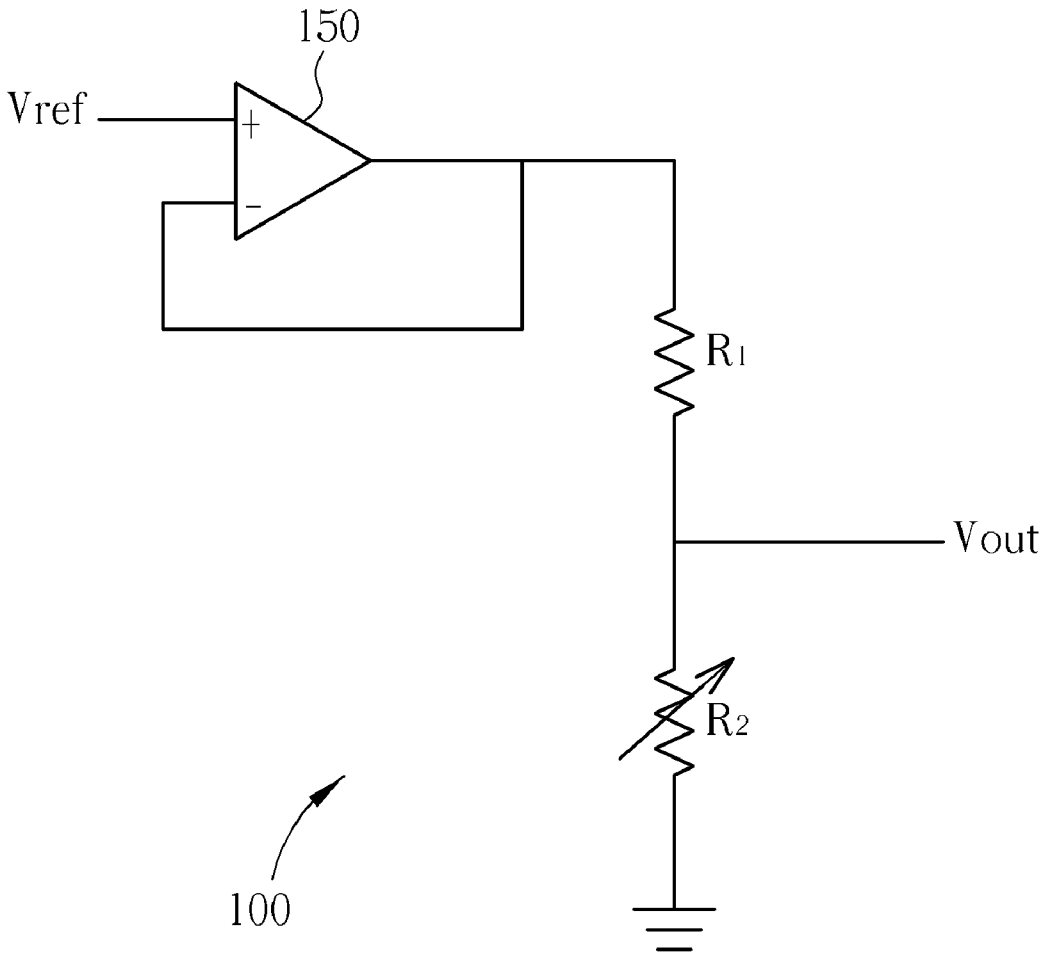
FIG. 1 RELATED ART
FIG. 1 is a diagram of a reference voltage generation circuit according to the prior art.
Figure 2:
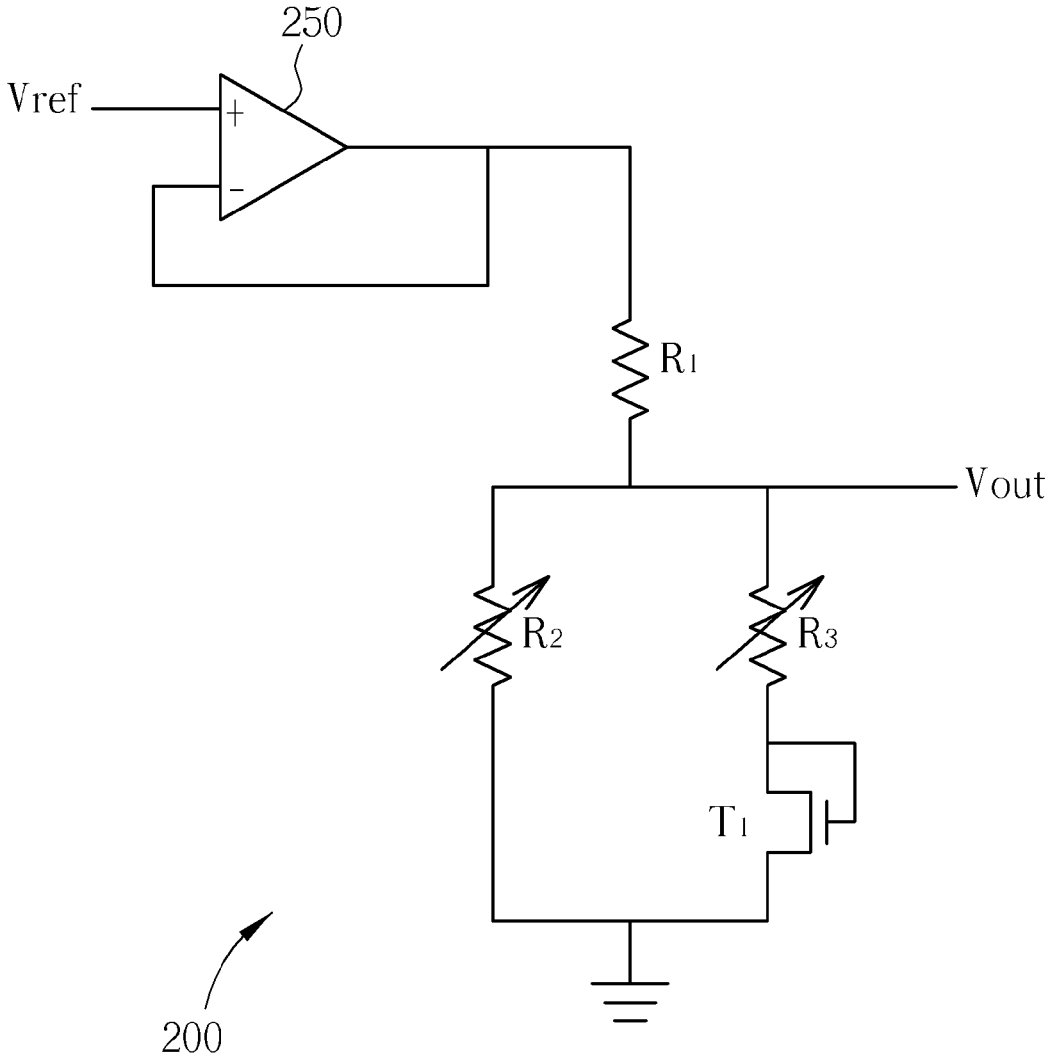
FIG. 2 is a diagram of a voltage reference generation circuit according to a first embodiment of the present invention.

Please refer to FIG. 2. FIG. 2 is a diagram of a voltage reference generation circuit 200 according to an exemplary embodiment of the present invention. The circuit 200 comprises a comparator 250 having a PVT independent voltage as a first input, and a feedback output as the second input. The output of the comparator 250 is coupled to a first resistor R1, which is coupled to a second resistor R2 and a third resistor R3 coupled in parallel. A transistor T1 is coupled between the third resistor R3 and ground.

The transistor T1 has a very high transconductance ($g_m$). The second resistor R2 and the third resistor R3 are both variable resistors. The high transconductance of the transistor T1 allows a voltage output of the circuit 200 to track with the gate-to-source voltage of the transistor T1. This means that, as the gate-to-source voltage of the transistor T1 varies so will the generated output voltage. The amount of temperature dependence of the output depends on the sizes of the respective resistances of R2 and R3. When R3 is set to infinity then the circuit 200 will operate as though R3 and the transistor T1 are not there, i.e. as in the prior art. In this case, the output voltage will be temperature independent but the size of the output voltage will depend on the resistance of R2.

When R2 is set to infinity and R3 is set to zero, the output will track with the gate-to-source voltage of the transistor T1, i.e. when the gate-to-source voltage of the transistor T1 varies according to temperature or process effects, these effects will also be seen on the reference voltage produced by the circuit 200. When R2 is set to infinity and R3 is set to be a value between zero and infinity, the output will track according to different amounts of temperature and process variations. The maximum dependency on temperature and process is when the ratio of the first resistor R1 to the third resistor R3 is maximized. The output voltage can be represented by the following equation:

$$Vout = \left[\frac{Vref}{R2} + \frac{(Vref - Vt)}{R3}\right] \times R1 + Vref \tag{1}$$

This can be expanded to be:

$$Vout = Vref\left[\frac{R1}{R2} + \frac{R1}{R3} + 1\right] - vt\left[\frac{R1}{R3}\right] \tag{2}$$

Figure 3:
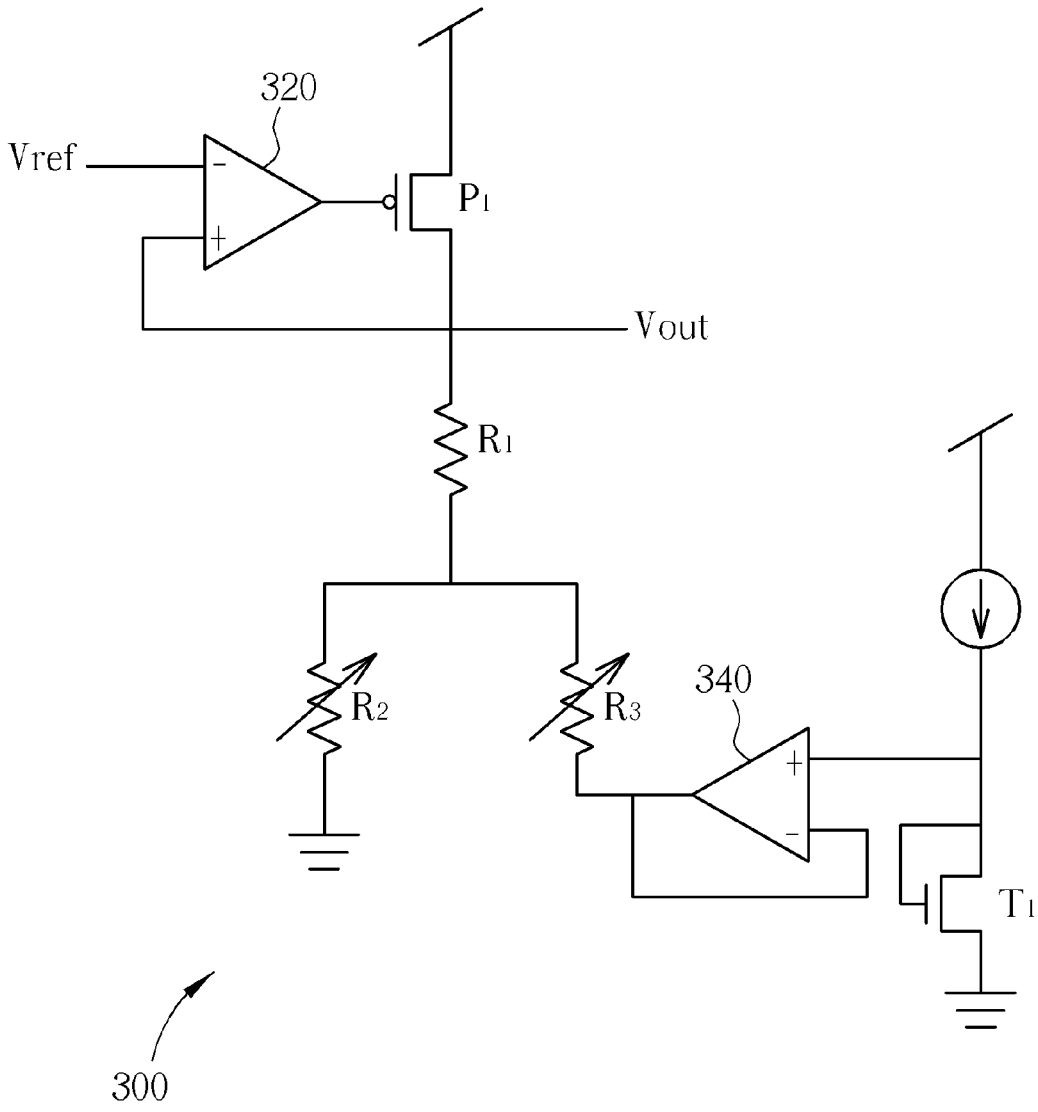
FIG. 3 is a diagram of a voltage reference generation circuit according to a second embodiment of the present invention.

Please refer to FIG. 3. FIG. 3 is a diagram of a circuit 300 for producing an output reference voltage of variable PVT dependency according to a second embodiment of the present invention. In some cases, it is not possible to employ a high transconductance transistor. In these cases, the circuit 200 can be modified to include an ideal operational amplifier 340 and a constant current source, as shown in the circuit 300. The circuit 300 also includes a PFET P1, coupled between the output of the comparator 320 and the first resistor R1. The transistor T1 has a constant gate-to-source voltage, and therefore when R2 is set to infinity and R3 is set to zero, the output voltage will track with the voltage of the transistor T1, as in the first embodiment.

The present invention provides means and apparatus for generating a reference voltage that can selectively track with the voltage of a transistor, or can be temperature and process independent, allowing for greater flexibility of design and usage.

Those skilled in the art will readily observe that numerous modifications and alterations of the device and method may be made while retaining the teachings of the invention.

What is claimed is:

1. A reference voltage generation circuit for generating a reference voltage that can adaptively depend on temperature and process, comprising:

a comparator, having a process, temperature and voltage (PVT) insensitive reference as a first input, and a feedback of the output as a second input, for generating a voltage reference output;

a first resistor, coupled to the output of the comparator;

a second and a third variable resistor coupled in parallel, and coupled between the first resistor and ground, for varying the temperature dependence of the output according to their respective resistance values; and a transistor, coupled in series between the third variable resistor and ground;

wherein the transistor has a high transconductance so that when the second variable resistor is set to infinity and the third variable resistor is set to zero, the generated reference voltage will track with a voltage of the transistor.

2. The reference voltage generation circuit of claim 1, wherein when the third variable resistor is set to infinity, the generated reference voltage will be PVT insensitive.

3. A reference voltage generation circuit for generating a reference voltage that can adaptively depend on temperature and process, comprising:

a comparator, having a process, temperature and voltage (PVT) insensitive reference as a first input, and a feedback of the output as a second input, for generating a voltage reference output;

a first resistor, coupled to the output of the comparator;

a second and a third variable resistor coupled in parallel, and coupled between the first resistor and ground, for varying the temperature dependence of the output according to their respective resistance values;

a transistor, coupled in series between the third variable resistor and ground;

a PFET, coupled between the output of the comparator and the first resistor;

an ideal operational amplifier, coupled between the third resistor and the transistor; and a constant current source, input to the ideal operational amplifier and the transistor.

* * * * *